US007160355B2

(12) United States Patent
Steiner

(10) Patent No.: US 7,160,355 B2
(45) Date of Patent: Jan. 9, 2007

(54) METHOD AND SYSTEM FOR REGENERATING DIESEL PARTICLE FILTERS

(75) Inventor: Dietmar Steiner, Welzheim (DE)

(73) Assignee: Robert Bosch GmbH, Stuttgart (DE)

( * ) Notice: Subject to any disclaimer, the term of this patent is extended or adjusted under 35 U.S.C. 154(b) by 255 days.

(21) Appl. No.: 10/470,114

(22) PCT Filed: Nov. 6, 2002

(86) PCT No.: PCT/DE02/04102

§ 371 (c)(1),
(2), (4) Date: Jan. 21, 2004

(87) PCT Pub. No.: WO03/048535

PCT Pub. Date: Jun. 12, 2003

(65) Prior Publication Data

US 2004/0112218 A1 Jun. 17, 2004

(30) Foreign Application Priority Data

Nov. 29, 2001 (DE) ..... 101 58 569

(51) Int. Cl.
*B01D 46/00* (2006.01)
*F01N 3/023* (2006.01)

(52) U.S. Cl. ..... 95/8; 95/273; 95/278; 95/279; 95/283; 95/286; 55/282.2; 55/282.3; 55/302; 55/385.3; 55/417; 55/418; 55/482; 55/484; 55/523; 55/DIG. 10; 55/DIG. 30; 60/273; 60/296; 60/303; 60/311

(58) Field of Classification Search ..... 55/282.2, 55/282.3, 302, 385.3, 523, DIG. 10, DIG. 30, 55/482, 484, 417, 418, 418.1; 95/273, 278, 95/279, 283, 286, 8; 60/273, 295, 296, 303, 60/311

See application file for complete search history.

(56) References Cited

U.S. PATENT DOCUMENTS

| | | | | |
|---|---|---|---|---|
| 4,217,757 | A * | 8/1980 | Crone, Jr. | 60/311 |
| 4,558,565 | A * | 12/1985 | Kojima et al. | 55/DIG. 30 |
| 4,671,059 | A * | 6/1987 | Lawson | 60/311 |
| 4,867,768 | A * | 9/1989 | Wagner et al. | 55/523 |
| 4,934,142 | A * | 6/1990 | Hayashi et al. | 55/DIG. 30 |
| 4,945,722 | A | 8/1990 | Goerlich | |
| 5,067,973 | A * | 11/1991 | Pattas | 55/523 |
| 5,194,078 | A * | 3/1993 | Yonemura et al. | 55/523 |
| 6,675,572 | B1 * | 1/2004 | Everingham et al. | 60/278 |

FOREIGN PATENT DOCUMENTS

| | | |
|---|---|---|
| DE | 37 22 970 | 2/1988 |
| DE | 198 07 203 | 8/1999 |

* cited by examiner

*Primary Examiner*—Jason M. Greene
(74) *Attorney, Agent, or Firm*—Kenyon & Kenyon LLP

(57) ABSTRACT

A method of regenerating at least one diesel particle filter, in which exhaust gas is introduced through a supply line into the at least one diesel particle filter and is discharged from it through a discharge line, while heating of the exhaust gas flowing through the at least one diesel particle filter takes place, a closed circulating air circuit being created through which exhaust gas emerging from the at least one diesel particle filter may be introduced back into the latter.

10 Claims, 2 Drawing Sheets

METHOD AND SYSTEM FOR REGENERATING DIESEL PARTICLE FILTERS

FIELD OF THE INVENTION

The present invention relates to a method and a system for regenerating diesel particle filters.

BACKGROUND INFORMATION

Particle emission standards of the EU 4 exhaust gas standard (0.05 g/km) can be met by heavy vehicles only with diesel particle filters (DPFs). DPF systems typically cut the emitted particles by 90–95%. The particles that become deposited in the filter as a result increase the exhaust gas back pressure, so that the diesel particle filter has to be regenerated at intervals between 200 and 500 km. The regeneration is accomplished by burning off (oxidizing) the deposited particles. This typically requires the particles to be heated to around 600° C. It is practical for the heating of the particles to be accomplished by convective input of heat through the exhaust gas stream. However, the temperature of the exhaust gas stream of diesel engines optimized for fuel consumption (TDI, CDI) only exceeds 300° C. at a few operating points. The exhaust gas therefore has to be heated additionally during the regeneration. This can be done electrically or by using a burner. Since the residual oxygen content of the exhaust gas fluctuates between 3% and 18%, using a diesel burner in the direct exhaust gas stream without an additional fresh air blower is problematic, since there is not sufficient oxygen available at all times to burn the fuel.

Conventionally, the ignition temperature of the particles is lowered to around 350° C. by adding organometallic iron or cerium compounds to the diesel fuel as additives. However it must be remembered in that case that such additives leave inorganic ash in the particle filter, resulting in a continuous rise in the back pressure produced by the diesel particle filter, which may make early replacement of the filter necessary.

Conventionally, electrically heatable diesel particle filters in partial stream or full stream solutions. In full stream systems, during the regeneration the entire exhaust gas stream is passed through the diesel particle filter and electrically heated. Such full stream systems do without switchable flaps, and can be manufactured relatively inexpensively and compactly. A disadvantage of such solutions, however, is that the entire mass flow of exhaust gas has to be heated above the ignition temperature of the diesel particulate. As an example, let us assume a piston displacement of 2.5 liters, an engine speed of 2000 rpm, and a boost pressure of 1.4 bar. This produces an exhaust gas flow of 250 kg/h. To heat this typically obtained mass flow by 400 K, the minimum heating power, ignoring losses, is 33 kW. Since a maximum of 2–2.5 kW of electrical heating power is implementable with a 12-volt on-board electrical system, partial stream solutions are generally preferred. A conventional partial stream system is shown in FIG. 1. Two diesel particle filters 1, 2, connected in parallel with each other, are recognizable. A flap 4 is inserted into the exhaust gas supply line 3 of these diesel particle filters, by which the exhaust gas in supply line 3 can be introduced optionally through a supply line 3*a* into diesel particle filter 1 or through a supply line 3*b* into diesel particle filter 2. Diesel particle filters 1, 2 each have electric heaters 1*a*, 2*a*. Fresh air may be introduced into supply lines 3*a*, 3*b* by a blower 5. Exhaust gas emerging from diesel particle filters 1, 2 is carried away through discharge lines 6*a* and 6*b*, respectively, which lead into a line 6.

With a system of this sort, it is practical for the diesel particle filters to be subjected to regeneration individually.

For example, during regeneration of diesel particle filter 1, the bulk of the exhaust gas stream (for example 90%) is routed by flap mechanism 4 through diesel particle filter 2. The remainder of the stream is heated electrically, or also by fossil fuel, and heats diesel particle filter 1 and the diesel particulate which is deposited there. If the residual oxygen content of the exhaust gas stream is too low, fresh air can be fed in by blower 5. However, the maximum pressure buildup of the blower, typically up to 150 hPa, limits its use to relatively small overpressures in the exhaust gas tract. The magnitude of the partial stream can be adjusted or dimensioned so that diesel particle filter 1 is heated above the ignition temperature of the diesel particulate in a short time, using the maximum implementable electrical heating power.

After the regeneration of diesel particle filter 1 has ended, diesel particle filter 2 can be regenerated. It is also possible to provide phases between the regeneration of the individual diesel particle filters in which exhaust gas is sent to both diesel particle filters equally, corresponding to normal operation.

SUMMARY

An object of the present invention is to carry out regeneration of diesel particle filters in the simplest and most inexpensive manner possible.

According to an example embodiment of the present invention, the regeneration is carried out in an at least partially closed circuit of circulating air allows regeneration generally independently of the magnitude of the exhaust gas stream, the residual oxygen content, and the pressure level. Because the exhaust gas is passed repeatedly through the diesel particle filter, the heating time is greatly shortened, allowing energy to be saved.

It may be useful to provide for mixing ambient air into the circulating air circuit. Due to the small mass flow implementable according to the present invention in the circulating air circuit, as well as this sort of limited metering of fresh air, it is possible to achieve high temperatures in the diesel particle filter very quickly despite the low electrical heating power. This makes it possible to regenerate the diesel particle filter effectively even without adding additives to a diesel fuel, so that it is also possible to prevent ash formation in the diesel particle filter due to inorganic additive residues. The controlled addition of fresh air or oxygen to the circulating air stream, in addition to the magnitude of the circulating air stream, which is regulatable by a blower speed, as well as the electrical heating power, constitutes an additional parameter for regulating the temperature of the diesel particle filter during "thorough ignition" of (flame propagation through) the exhaust particulate. Through appropriate regulation of these parameters it is possible to prevent local and temporal temperature spikes in the diesel particle filter, prolonging the life expectancy of the filter.

It is possible and useful, while introducing fresh air into the generally closed circuit, to blow circulating air out of the circuit.

According to an example embodiment of a method according to the present invention, the burnoff of diesel particulate produced in conjunction with the regeneration of the at least one diesel particle filter is detected through a measurement of the oxygen differential at the input and output sides of the diesel particle filter. This measuring procedure proves to be very reliable in practice. In conjunction with the system according to the present invention, oxygen sensors positionable, for example, upstream and downstream from the diesel particle filter are provided as suitable means for this.

It may be advantageous for the quantity of fresh air added to correspond to the quantity of circulating air blown out.

According to an example embodiment of the method and system according to the present invention, a stream of exhaust gas acting on two diesel particle filters connected in parallel is diverted in such a way that essentially the complete exhaust gas stream acts on a first diesel particle filter, and at the same time a closed circuit of circulating air is produced with respect to the second diesel particle filter. An essentially complete exhaust gas stream here designates in particular proportions between 80% and 100% of the entire exhaust gas stream.

DETAILED DESCRIPTION

Figure 1:
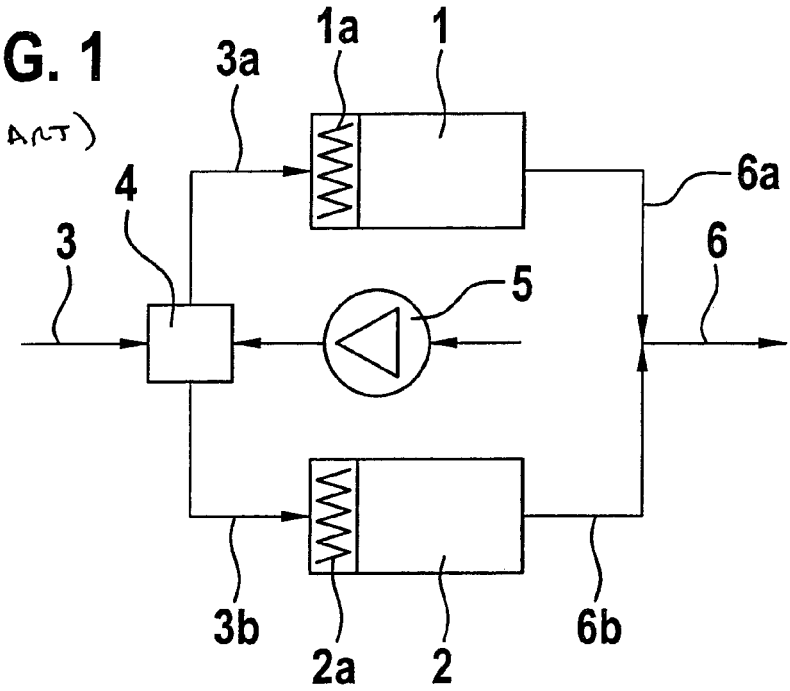
FIG. 1 (PRIOR ART)
FIG. 1 shows a block diagram to illustrate conventional electrical regeneration of diesel particle filters.
Figure 2:
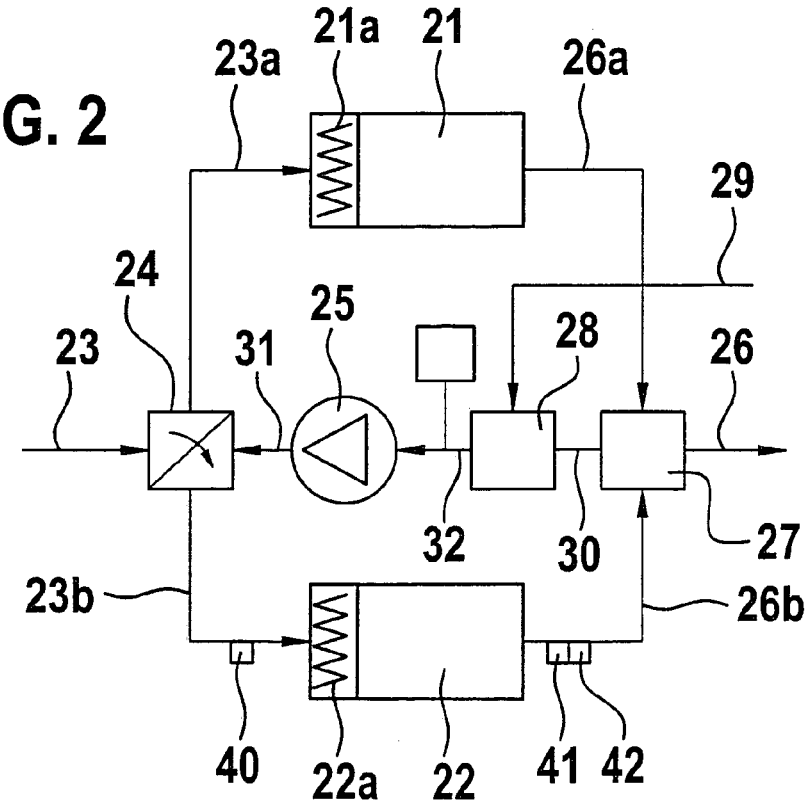
FIG. 2 shows a block diagram of an example embodiment of a system according to the present invention for regenerating two diesel particle filters.

FIG. 2 shows an example embodiment of the system according to the present invention which, like the conventional system described above, has two diesel particle filters 21, 22, each having an electric heater 21*a*, 22*a* associated with it. Exhaust gas may be fed to diesel particle filters 21, 22 through an exhaust gas supply line 23. Line 23 is connectable via a flap 24 to a first exhaust gas supply line 23*a*, which is connected to diesel particle filter 21, and to a second exhaust gas supply line 23*b*, which is connected to diesel particle filter 22. By positioning flap 24 appropriately, it is possible to distribute the stream of exhaust gas flowing through exhaust gas supply line 23 to diesel particle filters 21 and 22 in any manner desired.

Discharge lines 26*a* and 26*b*, which lead out of the particular diesel particle filters, feed to a flap 27. In a first position, flap 27 ensures that discharge lines 26*a*, 26*b* lead into a common discharge line 26. In a second position, flap 27 may be set in such a way that gas (exhaust gas) flowing through lines 26*a* or 26*b* may be guided through a line 30, a flap 28, into a line 32, through a blower 25 and flap 24 back into the particular diesel particle filter 21, 22.

Fresh air may be introduced into the exhaust gas stream via flap 28, through a supply line 29.

By setting flaps 24, 27, and 28 appropriately, it is possible in a simple manner to route the gas streams to implement the example method according to the present invention. This will be explained below on the basis of FIGS. 3 and 4.

Figure 3:
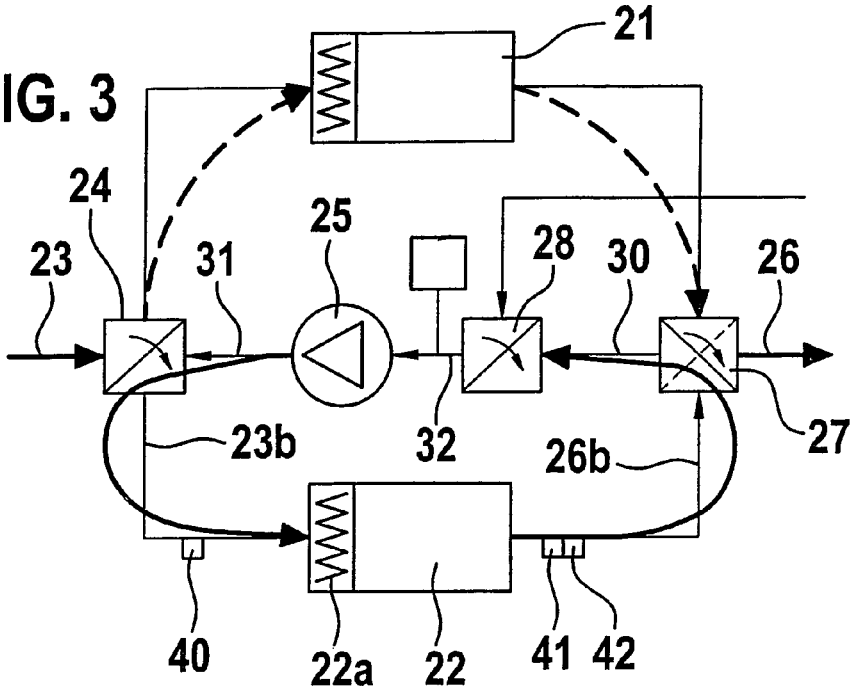
FIG. 3 shows the block diagram according to FIG. 2, depicting the exhaust gas or gas streams that occur here in order to illustrate a first phase of an example embodiment of the regeneration method according to the present invention.

FIG. 3 shows as an example the first phase of a regeneration of lower diesel particle filter 22. Flaps 24 and 27 are set so that the entire stream of exhaust gas flowing in through supply line 23 is guided to upper diesel particle filter 21, and from it into discharge line 26. This stream is represented by the dashed arrows. This setting of flaps 24 and 27, and an additional closed position of flap 28, causes a closed conduction system to be produced at the same time with respect to lower diesel particle filter 22. By switching on blower 25, it is possible to feed exhaust gas to diesel particle filter 22 in circulating air mode. Blower 25 has to propel only a relatively small mass flow here, namely the mass flow that exists inside diesel particle filter 22 and the closed conduction system (lines 23*b*, 26*b*, 30, 32, and 31) at the time of the aforementioned setting of flaps 24, 27, and 28. In typically dimensioned regeneration systems, it may be assumed that the maximum mass flow to be conveyed here is around 20 kg/h, so that the pressure drop through diesel particle filter 22 filled with particulate is relatively small, typically 50 hPa maximum.

By switching on electric heater 22*a* of diesel particle filter 22, it is now possible effectively to heat the exhaust gas flowing through the diesel particle filter in circulating air mode.

Electric heater 22*a*, which is usefully designed as an electric heating coil, heats diesel particle filter 22 though radiation coupling, as well as by convection through the stream of circulating air. Since no air escapes from the system at first, the heating takes place very quickly, as stated earlier.

The flow paths for implementing the circulating air mode are represented by the continuous arrows in FIG. 3.

Figure 4:
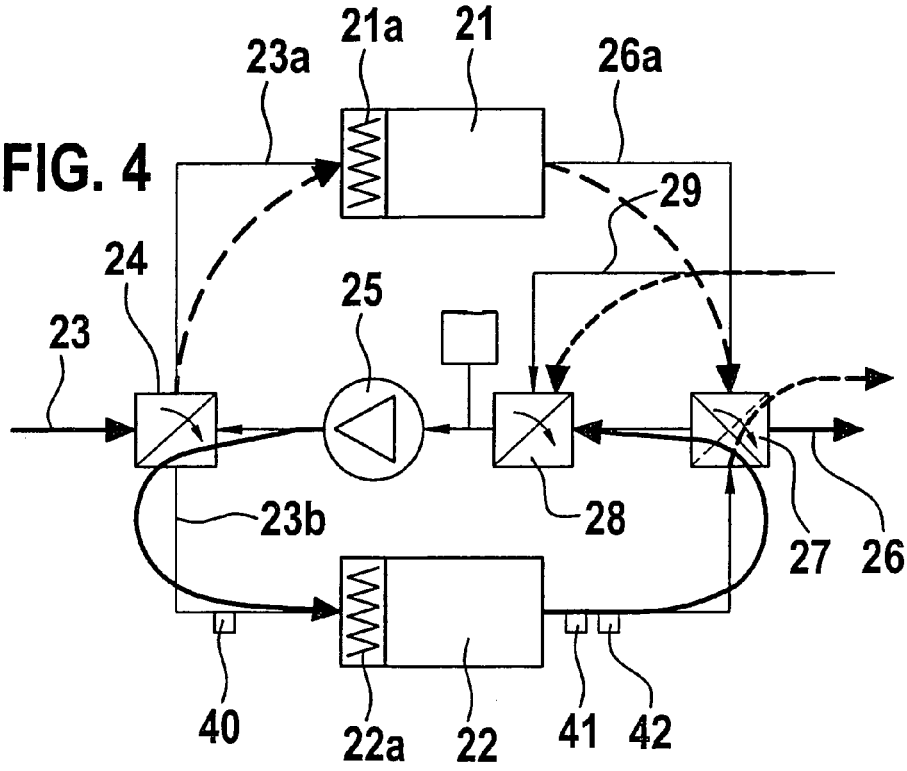
FIG. 4 shows the block diagram according to FIG. 2, depicting the exhaust gas or gas streams that occur here in order to illustrate a second phase of an example embodiment of the regeneration method according to the present invention.

When a maximum allowable temperature for the blower is reached, for example 300° C., flap 28 opens and adds a controlled amount of fresh air to the circulating air circuit. By opening flap 27 appropriately, circulating air is simultaneously blown out of the closed circuit into the exhaust gas tract (discharge line 6), it being useful to create equilibrium between the aspirated fresh air and the expelled circulating air. The position of flap 28 is controlled in such a way that the maximum allowable temperature for blower 25 is never exceeded. This condition is depicted in FIG. 4, the stream of fresh air and the expulsion stream being shown by dotted arrows.

In this operating mode, diesel particle filter 22 continues to be heated until the ignition temperature of the deposited particulate is reached. The "thorough ignition" of the diesel particulate may be carried out based on measurements of the oxygen consumption due to the oxidation within diesel particle filter 22. It is useful here to provide lambda probes 40, 41 at the input side and output side of diesel particle filter 22. It is also possible to measure the pressure drop within the diesel particle filter by corresponding pressure measurements on the input and output sides. Finally, it is possible to ascertain the "thorough ignition" of the diesel particulate by measuring the temperature on the output side. A corresponding temperature measuring device, by which it is possible to detect a steep temperature rise characterizing the "thorough ignition," is designated schematically in FIG. 3 by 42.

The temperature of diesel particle filter 22 may be controlled by controlling the heating power of electric heater 22*a* or the transport volume of blower 25. Also, through controlled addition of fresh air (by controlling flap 28), it is possible to control the oxygen content of the circulating air, and hence the speed of burnoff of the particulate. This measure makes it possible to effectively prevent overheating and damage to diesel particle filter 22 by the combustion enthalpy released during burnoff of the diesel particulate.

By appropriately repositioning flaps 24 and 27, it is then possible to discharge the exhaust gas stream fed in from supply line 23 generally completely through diesel particle filter 22, and to create a closed circulating air circuit with respect to diesel particle filter 21. Flaps 24 and 27 may be repositioned immediately after the regeneration procedure for diesel particle filter 22 is completed. It is also possible, after regenerating diesel particle filter 22, to first feed exhaust gas to both diesel particle filters, and to not initiate the corresponding regeneration of diesel particle filter 21 until a later time. It is of course possible to provide lambda probes and/or a temperature measuring device for diesel particle filter 21, analogous to diesel particle filter 22; these are not shown in detail in FIG. 3, however, for the sake of clarity.

In conclusion, the advantages resulting according to the example embodiment of the present invention will be summarized once more as follows:

The regeneration of the diesel particle filters takes place in the at least partially closed circulating air circuit, independently of the magnitude of the exhaust gas stream and of the residual oxygen content and pressure level of the exhaust gas stream. An employed blower merely needs to overcome the back pressure or pressure drop of a diesel particle filter. Moreover, it is possible to greatly reduce the heating time for a diesel particle filter, causing energy to be saved. Because of the small mass flow in the circulating air circuit and the limited addition of fresh air, it is possible to reach high temperatures in the diesel particle filter despite low electrical heating power. This enables the diesel particle filter to be regenerated effectively, even without adding additives to the diesel fuel.

The controlled addition of fresh air or oxygen to the circulating air stream, in addition to the magnitude of the circulating air stream, which is adjustable through the blower speed, as well as the electrical heating power, constitutes another actuator for regulating the temperature of the diesel particle filter during "thorough ignition" of the particulate. This makes it possible to prevent local and temporal temperature spikes in a diesel particle filter, significantly prolonging the life expectancy of the filter.

What is claimed is:

1. A method for regenerating at least one diesel particle filter, comprising:

introducing exhaust gas through a supply line into the at least one diesel particle filter;

discharging the exhaust gas from the at least one diesel particle filter through a discharge line, heating of the exhaust gas flowing through the at least one diesel particle filter taking place;

introducing the exhaust gas discharged from the at least one particle filter back into the at least one diesel particle filter via a closable circulating air circuit; and burning off diesel particulate in conjunction with a regeneration of the at least one diesel particle filter as a function of a measurement of an oxygen differential at an input and an output side of the at least one diesel particle filter.

2. The method as recited in claim 1, further comprising:

adding ambient air to the circulating air circuit.

3. The method as recited in claim 2, further comprising:

blowing out air circulating in the circulating air circuit in a regulated or controlled manner.

4. The method as recited in claim 3, wherein a quantity of air fed in corresponds to the quantity of circulating air blown out.

5. The method as recited in claim 1, wherein the at least one diesel particle filter includes at least two diesel particle filters connected in parallel, and the method further comprises:

diverting an exhaust gas stream so that a complete exhaust gas stream is passed through a first of the diesel particle filters, and a closed circulating air circuit is provided with respect to a second one of the diesel particle filters.

6. The method as recited in claim 5, wherein the diversion of the exhaust gas stream is effected by flaps inserted into the supply or discharge lines for the exhaust gas stream.

7. A system for regenerating at least one diesel particle filter which is connected to a supply line for supplying exhaust gas and a discharge line for discharging exhaust gas, comprising:

an arrangement to heat the exhaust gas flowing through at least one diesel particle filter;

an arrangement which creates a closable circulating air circuit through which exhaust gas emerging from the at least one diesel particle filter is introducible back into the at least one diesel particle filter; and an arrangement which measures an oxygen differential at an input and an output side of the at least one diesel particle filter.

8. The system as recited in claim 7, further comprising:

an arrangement which adds ambient air to the circulating air circuit.

9. The system as recited in claim 7, further comprising:

an arrangement which blows exhaust gas from the circulating air circuit in a regulated or controlled manner.

10. The system as recited in claim 7, wherein the at least one diesel particle filter includes at least two diesel particle filters, the at least two diesel particle filters being arranged in such a way that a complete exhaust gas stream is passable through a first diesel particle filters, and a closed circulating air circuit is provided with respect to a second one of the diesel particle filters, the system further comprising:

flaps insertable into the supply or discharge lines to divert the exhaust gas stream.

* * * * *